US006307183B1

(12) United States Patent
Ou-Yang

(10) Patent No.: US 6,307,183 B1
(45) Date of Patent: Oct. 23, 2001

(54) IGNITION DEVICE FOR ELECTRONIC LIGHTER WITH HEATING WIRE CERAMIC MOUNT HAVING HEMISPHERICAL GROOVE

(76) Inventor: Wei Ou-Yang, No. 24, Alley 47, Lane 115, Sec. 2, Cheng Kung Rd., Taipei (TW)

( * ) Notice: Subject to any disclaimer, the term of this patent is extended or adjusted under 35 U.S.C. 154(b) by 0 days.

(21) Appl. No.: 09/624,976

(22) Filed: Jul. 25, 2000

(51) Int. Cl.[7] ..... F23Q 7/00
(52) U.S. Cl. ..... 219/267; 219/260; 219/550
(58) Field of Search ..... 219/267, 268, 219/260, 550

(56) References Cited

U.S. PATENT DOCUMENTS

| | | | | |
|---|---|---|---|---|
| 2,199,885 | * | 5/1940 | Kravchuk | 219/268 |
| 2,761,947 | * | 9/1956 | Rice et al. | 219/260 |
| 3,392,265 | * | 7/1968 | King et al. | 219/268 |
| 5,274,214 | * | 12/1993 | Blackburn | 219/268 |

FOREIGN PATENT DOCUMENTS

| | | | | |
|---|---|---|---|---|
| 46362 | * | 10/1932 | (DK) | 219/268 |
| 90518 | * | 12/1967 | (FR) | 219/268 |
| 10810 | * | 7/1910 | (GB) | 219/267 |

* cited by examiner

*Primary Examiner*—John A. Jeffery
(74) *Attorney, Agent, or Firm*—Rosenberg, Klein & Lee

(57) ABSTRACT

An ignition device of an electronic lighter comprises a ceramic seat, electric heating wires, conductive wires, and a circuit board; the ceramic seat having a pair of through holes. The conductive wires pass through the through holes. A lower end of each conductive wire is connected to a bottom of a circuit board. An upper end of each conductive wire is bent to be connected to the electric heating wires. A top of the ceramic seat is formed with a hemispherical groove so that the electric heating wires do not contact the ceramic seat. Thus, it is avoided that ash seals the groove, and thus, the joint of the circuit board is directly connected to wires of power source. Therefore, the present invention only occupies a small space. The ceramic seat is formed by combining a primary seat and a secondary seat.

3 Claims, 4 Drawing Sheets

3-3

IGNITION DEVICE FOR ELECTRONIC LIGHTER WITH HEATING WIRE CERAMIC MOUNT HAVING HEMISPHERICAL GROOVE

FIELD OF THE INVENTION

The present invention relates to an ignition device of an electronic lighter, and especially to a lighting structure ignited by electric power.

BACKGROUND OF THE INVENTION

The electric ignition devices in the prior art have power source of cells for providing power to heat generating elements. In general, the heating generating element is electric heating wires. The electric power from the power source is transferred to the electric heating wires for being converted as thermal power. If the electric heating wires are hidden in a ceramic seat, the heat efficiency will be reduced. Thus, heat dissipation of the electric heating wires are large and rapidly, and longer time is required to ignite the lighting device. Therefore, there is an eager demand for a novel ignition device of an electronic lighter which can improve the defects in the prior art.

SUMMARY OF THE INVENTION

Accordingly, the primary object of the present invention is to provide an ignition device of an electronic lighter, in which since the ceramic seat is installed with a groove at the top thereof, the electric heating wires do not contact the ceramic seat, and thus, heat dissipation of the electric heating wires is retained so that a higher temperature is retained. A groove is formed at the top of the ceramic seat, and therefore, it is avoided that the ash from combusting objects will not seal the electric heating wires. Moreover, the present invention occupies a small space and a circuit board is used so as to be installed easily. The circuit board can be easily connected to a power source. A preferred use is provided.

In order to achieve the aforesaid object, the present invention provides an ignition device of an electronic lighter comprising a ceramic seat, electric heating wires, conductive wires, and a circuit board; the ceramic seat has a pair of through holes. The conductive wires pass through the through holes. A lower end of each conductive wire is connected to a bottom of a circuit board. An upper end of each conductive wire is bent to be connected to the electric heating wires. A top of the ceramic seat is formed with a hemispherical groove so that the electric heating wires do not contact the ceramic seat. Thus, it is avoided that ash seals the groove, and thus, the joint of the circuit board is directly connected to wires of the power source. Therefore, the present invention only occupies a small space. The ceramic seat is formed by combining a primary seat and a secondary seat. description when reading in conjunction with the appended drawing.

DETAILED DESCRIPTION OF THE PREFERRED EMBODIMENTS

Figure 1:
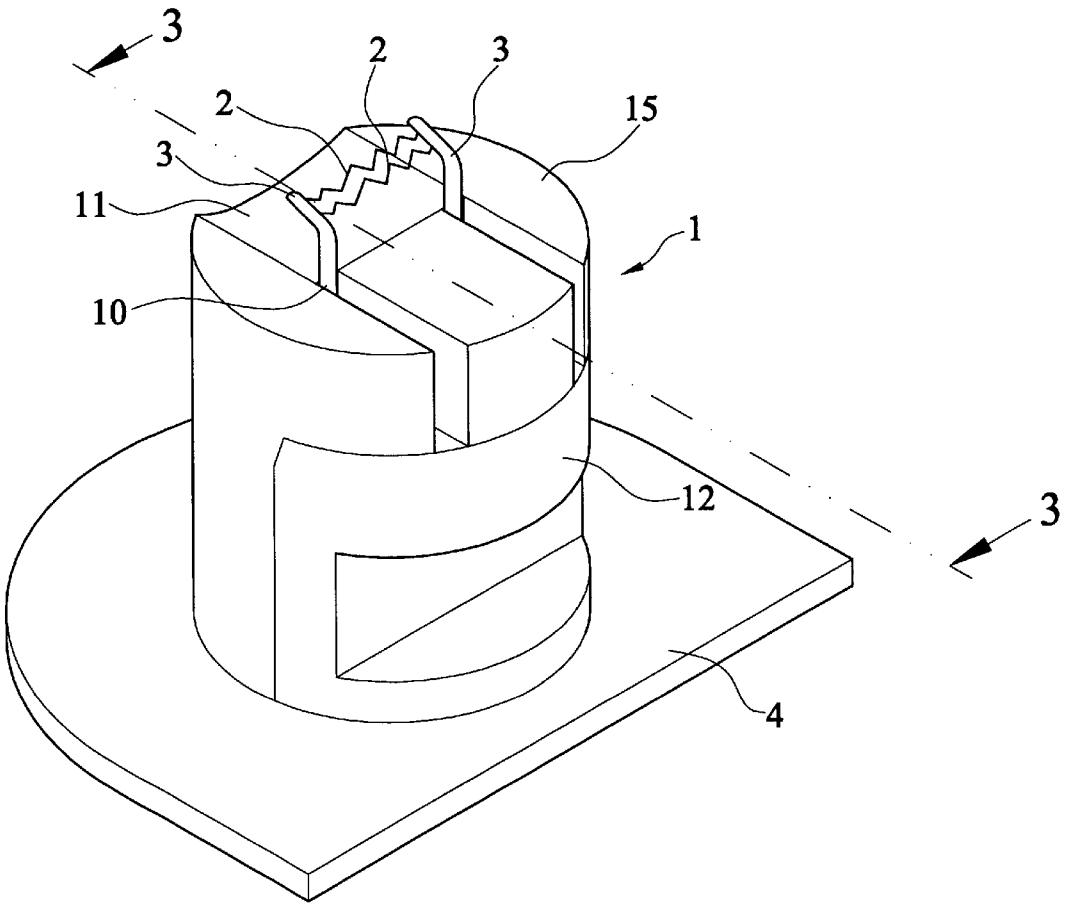
FIG. 1 is a perspective view of the present invention.
Figure 2:
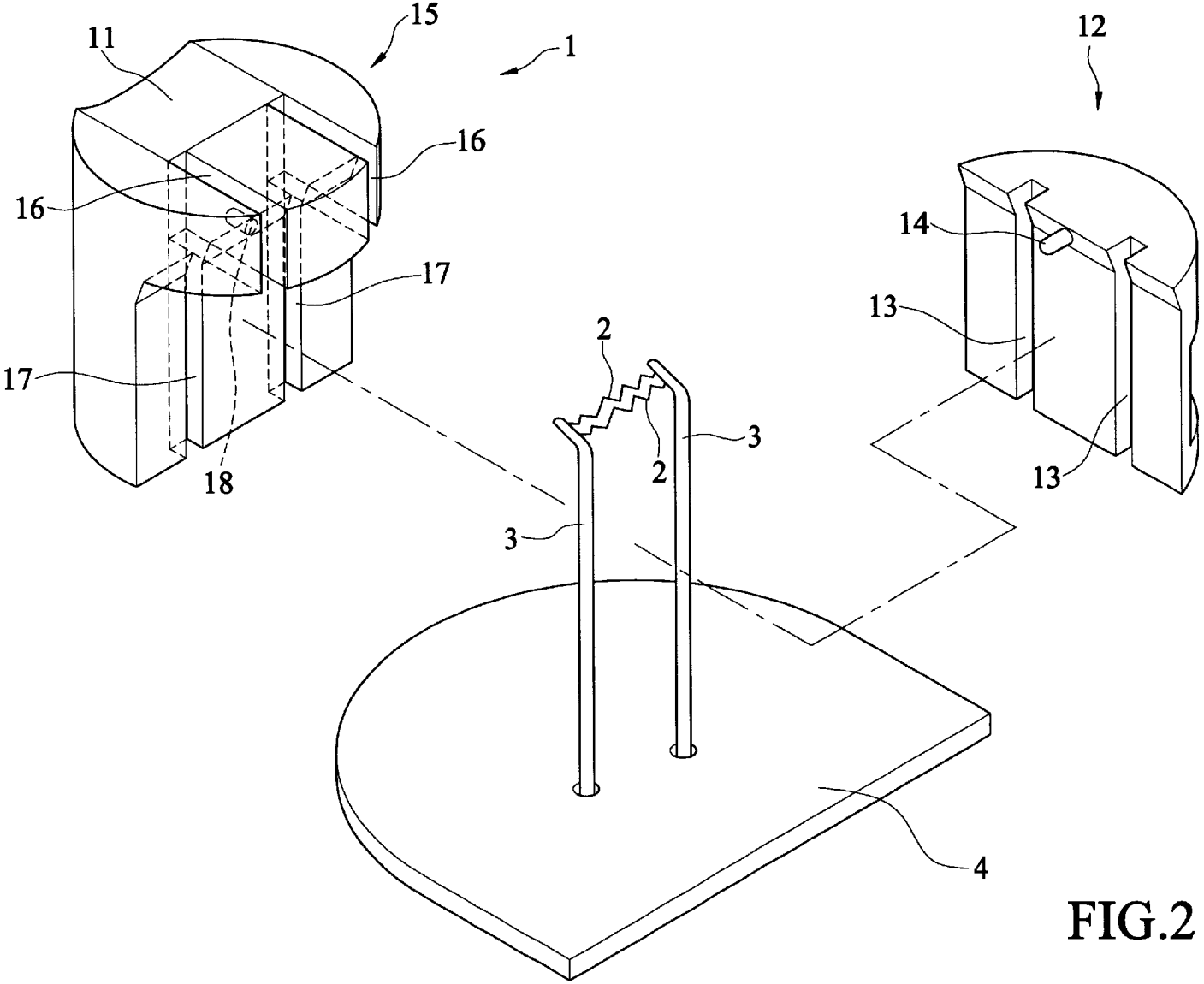
FIG. 2 is an exploded perspective view of the present invention.
Figure 3:
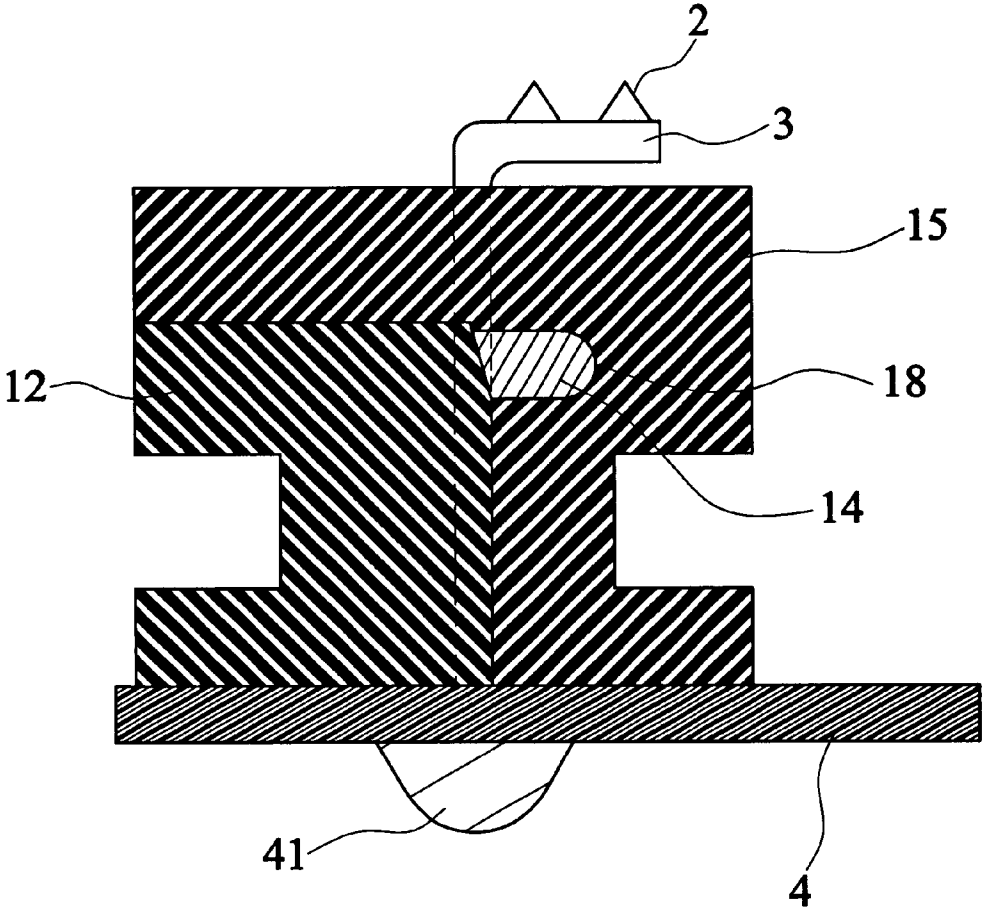
FIG. 3 is a cross sectional view along Line 3—3 of FIG. 1.
Figure 4:
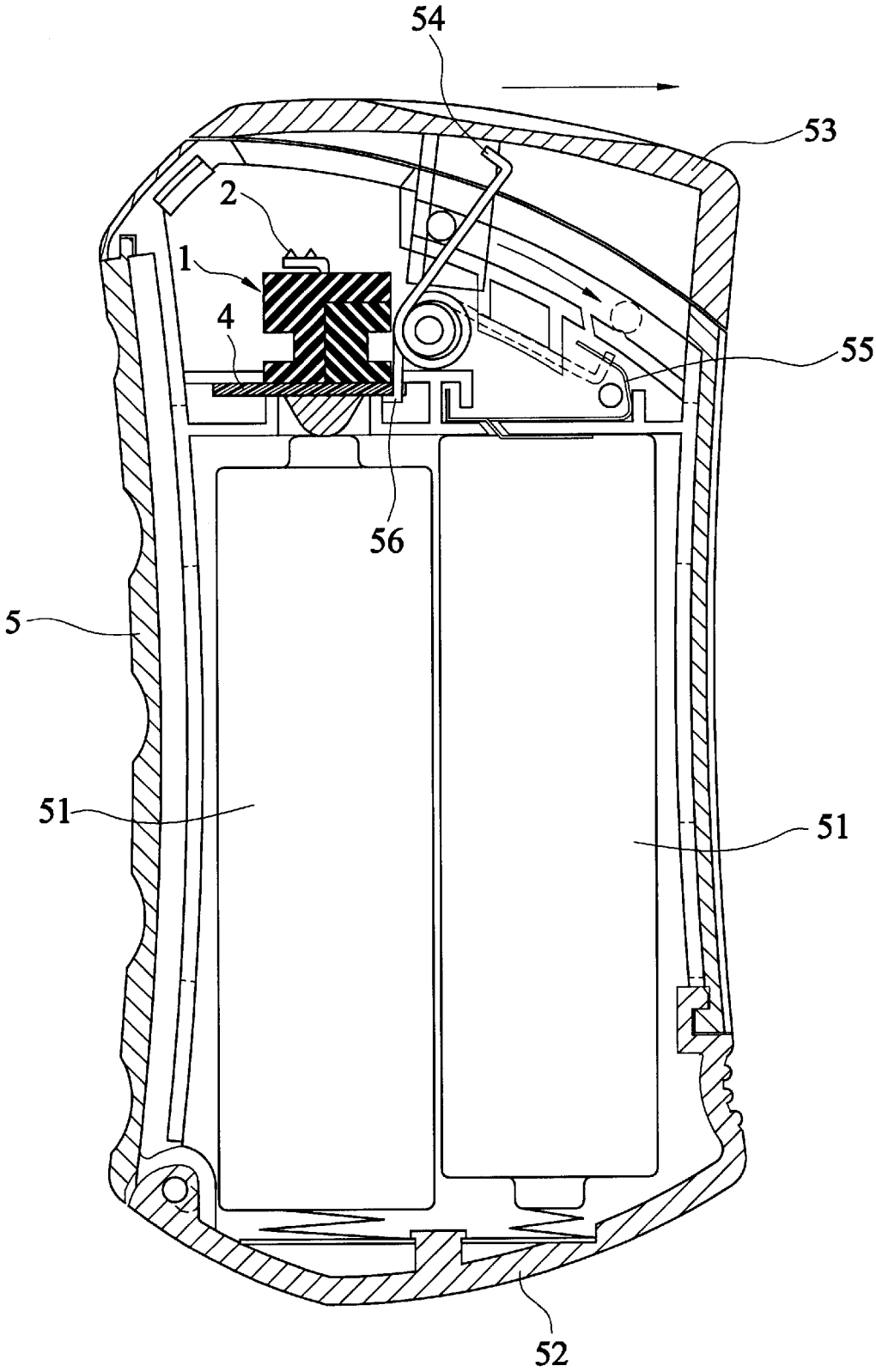
FIG. 4 is a cross sectional view showing the embodiment of the present invention.

With reference to FIGS. 1 to 4, the ignition device of an electronic lighter according to the present invention is illustrated. The ignition device of an electronic lighter includes a ceramic seat 1, electric heating wires 2, conductive wires 3, a circuit board 4. A pair of through holes 10 are formed in the ceramic seat 1. The conductive wires 3 pass through the through holes 10. The lower ends of the conductive wires 3 are connected to the bottom of the circuit board 4. The upper ends of the conductive wires 3 are bent with an angle to be connected with at least one electric heating wire 2. A pair of electric heating wires 2 are illustrated in the Figures. The top surface of the ceramic seat 1 is installed with a hemispherical groove 11 so that the electric heating wires 2 do not contact the groove of the ceramic seat 1. The joint 41 on the circuit board 4 may be directly connected to a power wire in order to reduce the whole space. The ceramic seat 1 is formed by a secondary seat 12 and a primary seat 15. The shape of the primary seat 15 is a round cylinder at the upper half and a semi-cylinder at the lower half. The upper half is cut to be formed with a pair of transversal grooves 16, while the lower half is formed with a pair of half inclined trenches 17. A pair of conductive wires 3 pass through the inclined trenches 17. Of course, the top surface of the primary seat 15 is formed with a groove 11, and an inserting hole 18 is formed in the inner surface thereof. The secondary seat 12 is semi-cylindrical. The inner surface thereof is installed with a pair of half inclined trenches 13. The half inclined trenches 13 and 17 are formed as the through hole 10. The inner surface thereof is formed with a post 14. The post 14 is exactly buckled in the inserting hole 18 so that the inner surface of the lower half of the primary seat 15 contacts the inner surface of the secondary seat 12. Then, the conductive wires 3 are positioned and the primary seat is adhered to the ceramic seat 1. Another, the ceramic seat 1 is fixed to the surface of the circuit board 4 and the upper ends of the conductive wires 3 are sightly protruded. FIG. 4 shows that the present invention is installed on a lighter. The lighter has a housing 5. A pair of cells 51 serve to supply power to the ignition device 1. The cells 51 are placed thereinto from a cell cover 52. The upper end of the housing 5 is installed with a pair of control devices 54 and 55 for power transfer. When one sliding cover 53 is open, the sliding cover 53 will drive an opening to cause a spring 54 to rotate so that one end of the spring is in contact with the conductive piece 55. While another end 56 of the spring 54 connects with a circuit board 4. Another end of the cell will be directly connected to the circuit board 4. Thus, current is conductive to transfer power to the circuit board 4 and then flows through the conductive wires 3 to cause the electric heating wires 2 to generate heat.

In the aforesaid structure, in the present invention, a ceramic seat with a primary seat and a secondary seat is used, which can be manufactured and combined easily. A pair of electric heating wires are connected between two upper ends of the conductive wires, then the two half ceramic seats are combined. Finally, the circuit board is fixed to the housing of an electronic lighter. Since the ceramic seat is installed with a groove, the electric heating wires do not make contact with the ceramic seat, and thus, heat dissipation of the electric heating wires is retained so that a higher temperature is retained. A groove is formed at the top of the ceramic seat, and therefore, it is avoided that the ash from the combusting objects will not seal the electric heating wires. Moreover, the present invention occupies a small space and a circuit board is used so as to be installed easily. The circuit board can be easily connected to a power source. A preferred use is provided. Therefore, the present invention has a structure completely different from that of the prior art.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. An ignition device of an electronic lighter comprising a ceramic seat, electric heating wires, conductive wires, and a circuit board; the ceramic seat having a pair of through holes; the conductive wires passing through the through holes; a lower end of each conductive wire being connected to a bottom of a circuit board; an upper end of each conductive wire being bent to be connected to the electric heating wires; a top of the ceramic seat being formed with a hemispherical groove so that the electric heating wires do not make contact with the ceramic seat; thereby avoiding the groove being sealed by ashes from combustion, and joints of the circuit board are directly connected to wires of a power source.

2. The ignition device of an electronic lighter as claimed in claim 1, wherein the ceramic seat is formed by a primary seat and a secondary seat.

3. The ignition device of an electronic lighter as claimed in claim 1, wherein the shape of the primary seat is a round cylinder at the upper half and a semi-cylinder at the lower half; the upper half of the primary seat is cut thereby forming a pair of transversal grooves, while the lower half is formed with a pair of half inclined trenches; a pair of conductive wires pass through the inclined trenches; the top surface of the primary seat is formed with a groove, and an inserting hole is formed in the inner surface thereof; the secondary seat is semi-cylindrical; the inner surface thereof is installed with a pair of half inclined trenches; the half inclined trenches are formed as the through holes; an inner surface of the secondary seat is formed with a post; the post is exactly buckled in the inserting hole so that the inner surface of the lower half of the primary seat is in contact with the inner surface of the secondary seat.

* * * * *